US009589550B2

(12) United States Patent
Kirsch et al.

(10) Patent No.: US 9,589,550 B2
(45) Date of Patent: Mar. 7, 2017

(54) METHODS AND SYSTEMS FOR MEASURING AND REPORTING AN ENERGY LEVEL OF A SOUND COMPONENT WITHIN A SOUND MIX

(75) Inventors: James Kirsch, Salt Lake City, UT (US); Harsha Inna Kedage Rao, Salt Lake City, UT (US)

(73) Assignee: HARMAN INTERNATIONAL INDUSTRIES, INC., Stamford, CT (US)

( * ) Notice: Subject to any disclaimer, the term of this patent is extended or adjusted under 35 U.S.C. 154(b) by 1236 days.

(21) Appl. No.: 13/200,798

(22) Filed: Sep. 30, 2011

(65) Prior Publication Data

US 2013/0083932 A1 Apr. 4, 2013

(51) Int. Cl.

| | |
|---|---|
| ***H04R 29/00*** | (2006.01) |
| ***H04S 7/00*** | (2006.01) |
| ***H04H 60/04*** | (2008.01) |
| ***G10H 1/46*** | (2006.01) |

(52) U.S. Cl.

CPC ..... *G10H 1/46* (2013.01); *H04H 60/04* (2013.01); *H04R 29/00* (2013.01); *H04R 29/008* (2013.01); *H04S 7/40* (2013.01); *G10H 2220/211* (2013.01); *H04R 2420/01* (2013.01)

(58) Field of Classification Search

CPC H04S 7/30; H04S 7/40; H04R 29/008; H04R 29/00; H04R 2430/01; H04R 2400/13; H04R 2420/01; G06F 3/04847; H04H 60/04; G11B 27/34; G10H 1/46; G10H 2220/211

USPC ..... 381/58, 119; 700/94; 715/716; 704/278

See application file for complete search history.

(56) References Cited

U.S. PATENT DOCUMENTS

| | | | | |
|---|---|---|---|---|
| 3,992,584 | A | 11/1976 | Dugan | |
| 4,357,492 | A * | 11/1982 | Campbell et al. | 381/107 |
| 5,228,093 | A | 7/1993 | Agnello | |
| 5,812,688 | A * | 9/1998 | Gibson | 381/119 |
| 6,246,773 | B1 * | 6/2001 | Eastty | 381/71.11 |
| 7,039,204 | B2 * | 5/2006 | Baumgarte | 381/119 |

(Continued)

FOREIGN PATENT DOCUMENTS

| | | |
|---|---|---|
| EP | 1377123 A1 | 1/2004 |
| EP | 1551119 A2 | 7/2005 |

OTHER PUBLICATIONS

Extended European Search Report—Application No. 12186430.0.

*Primary Examiner* — Davetta W Goins
*Assistant Examiner* — Daniel Sellers
(74) *Attorney, Agent, or Firm* — Artegis Law Group, LLP

(57) ABSTRACT

Various embodiments relate to determining an energy level of one or more sound components from a sound mix. Based on at least one sound mix signal received from a mixing device and at least one component signal received from one or more sound components, at least one signal value of the sound mix signal and at least one signal value of the component signal may be computed. The component signal corresponds to each of the one or more sound components. An energy level of the one or more sound components may be determined based on the sound mix signal value and the component signal value which corresponds to each of the one or more sound components. The energy level of the one or more sound components may be output in order to determine the energy level of each component in the sound mix.

22 Claims, 4 Drawing Sheets

(56) References Cited

U.S. PATENT DOCUMENTS

| | | | | |
|---|---|---|---|---|
| 7,333,618 | B2 | 2/2008 | Shuttleworth et al. | |
| 7,440,577 | B2 * | 10/2008 | Coats | 381/119 |
| 8,085,269 | B1 * | 12/2011 | Classen | 345/440 |
| 2004/0213420 | A1 * | 10/2004 | Gundry et al. | 381/104 |
| 2008/0002842 | A1 * | 1/2008 | Neusinger | G10L 19/26 381/119 |
| 2008/0008323 | A1 * | 1/2008 | Hilpert | G10L 19/008 381/1 |
| 2010/0309153 | A1 | 12/2010 | Terada | |

* cited by examiner

METHODS AND SYSTEMS FOR MEASURING AND REPORTING AN ENERGY LEVEL OF A SOUND COMPONENT WITHIN A SOUND MIX

TECHNICAL FIELD

Various embodiments relate to detecting at least one signal within a sound mix. In some embodiments, the level of the at least one detected signal is measured and reported relative to the sound mix. In additional or alternative embodiments, the level of the at least one detected signal may be an absolute determination.

BACKGROUND

The mix of a sound system varies with the position of the listener in the venue. Ideally, sound systems are mixed in the middle of an audience. However, this position is often not available to the sound engineer because of the amount of space taken by the audio gear which reduces the number of audience seats thereby leading to reduced ticket revenue. Often, the sound gear is placed next to the stage or on the stage and operated by one of the musicians. Even when the sound system is mixed from a non-ideal position, it is still necessary to know the content of the mix in the audience away from the gear. Sometimes headphones are used to try to listen to the mixing console's output, but the stage volume is often too loud to effectively hear the mix in the headphones.

SUMMARY

One aspect relates to a system for determining an energy level of one or more sound components from a sound mix. The system may include a sound mixing device which may be configured to output a sound mix based on a plurality of component signals from a plurality of sound components defining at least one sound mix signal. The sound components may include one or more microphones and/or one or more instruments. The system may also include an apparatus for determining the energy level of one or more sound components.

The energy level determining apparatus may be configured to receive at least one sound mix signal from the mixing device. The apparatus may also be configured to receive at least one component signal from the one or more sound components. In some embodiments, the at least component signal may be received via the mixing device.

The energy level determining apparatus may be further configured to compute a signal value of the at least one sound mix signal and a signal value of the at least one component signal, which corresponds to each of the one or more sound components. Further, an energy level of the one or more sound components may be computed based on the at least one sound mix signal value and the at least one component signal value corresponding to each of the one or more sound components. In some embodiments, the energy level of the one or more sound components may be output by the energy level determining apparatus for determining the energy level of each component in the sound mix.

In some embodiments, the energy level determining apparatus may execute instructions that define a signal processing filter (e.g., adaptive or non-adaptive). The signal processing filter may compute the signal value of the at least one component signal.

The energy level determining apparatus may be software embedded in the mixing device or a peripheral device connected to the mixing device. For example, the peripheral device may be a handheld device or a computer.

Another aspect relates to a method for determining an energy level of the one or more sound components. According to the method, at least one sound mix signal may be received from a mixing device. Further, at least one component signal may be received from one or more sound components.

A signal value of the at least one sound mix signal and a signal value of the at least one component signal may be computed. The component signals may correspond to each of the one or more sound components. Additionally, an energy level of the one or more sound components may be computed. This determination may be based on the at least one sound mix signal value and the at least one component signal value corresponding to each of the one or more sound components. The energy level of the one or more sound components may be output to report an energy level output for determining the energy level of each component in the sound mix.

In some embodiments, the mixing device may include an input on the mixing device defining single component signal transmission. If the input is received, the energy level output may be based on the signals transmitted from a single sound component.

In some embodiments, an input may be received that defines a selection of one or more units of measurement for the energy level of the one or more sound components. The at least one unit of measurement may defines an energy level output of the one or more sound components that is relative to an energy level of the sound mix. Alternatively, the at least one unit of measurement may define an energy level output of the one or more sound components that is an absolute value.

Another aspect relates to a system for determining an energy level of one or more sound components. The system may be configured to receive at least one sound mix signal from a mixing device. The system may be further configured to receive at least one component signal from one or more sound components. The system may also receive a mix including ambient noise from one or more sound capturing devices. The ambient noise may include, but is not limited to, traffic noise, amplifier noise, loudspeaker noise, and audience noise.

A signal value of the at least one sound mix signal, a signal value of the at least one component signal corresponding to each of the one or more sound components, and a signal value of the ambient noise may be computed. Further, an energy level of the one or more sound components may be determined. This determination may be based on the at least one sound mix signal value, the at least one component signal value corresponding to each of the one or more sound components, and the ambient noise signal value.

In some embodiments, the energy level of the one or more sound components may be output by the system. Based on the output, the energy level of each component in the sound mix may be determined. Further, the sound mix may be balanced based on the energy level output. In some embodiments, the sound mix may be automatically balanced. In additional embodiments, the output may include the energy level of the one or more sound components and the audibility of the sound components.

These and other aspects will be better understood in view of the attached drawings and the following detailed description.

BRIEF DESCRIPTION OF THE DRAWINGS

The figures identified below are illustrative of some embodiments of the invention. The figures are not intended to be limiting of the invention recited in the appended claims. The embodiments, both as to their organization and manner of operation, together with further object and advantages thereof, may best be understood with reference to the following description, taken in connection with the accompanying drawings, in which:

DETAILED DESCRIPTION

As required, detailed embodiments of the invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Additionally, the disclosure and arrangement of the figures is non-limiting. Accordingly, the disclosure and arrangement of the figures may be modified or re-arranged to best fit a particular implementation of the various embodiments of the invention.

According to one or more embodiments of the invention, systems may measure the presence of each of one or more component signals in a sound mix. By determining the actual presence of each component in a mix, better adjustments may be made to the mix to improve the sound. In some embodiments, using an auto-mixing algorithm, a balance of each component in a mix may be achieved.

According to one or more additional embodiments, sound systems with multiple loudspeakers may be tuned by playing a stimulus in each loudspeaker and the acoustic response may be measured at a microphone. Typically, each loudspeaker is individually tuned. However, this tuning can be made much faster if all the loudspeakers are tuned at once using a different stimulus in each loudspeaker.

The system may algorithmically detect a component signal in a mix signal and may determine the relative and absolute energy levels, or "presence," of that component in the mix. The level(s) may be displayed on a meter that is visible to a user such as a sound engineer. As a non-limiting example, the component signal could be from a singer's microphone while the mix contains the singer as well as drums, a guitar, and keyboards. This system may determine the level of the component signal (e.g., the singer's microphone) such as whether the signal is sufficiently present in the final mix or whether it is overbearing. As an example, the lead component should contain over 50% of the energy in the mix. In some embodiments, the lead component may be over 70%, but less than 90%. Of course, other energy level values may be utilized for a component according to the specific implementation of the invention.

It should be appreciated that the various embodiments of the system may be utilized during a live performance. Thus, the sounds may be output to an audience or listener(s) at a performance or event. Meanwhile, the signals may be analyzed by the sound engineer, which can be accomplished through the use of the presence estimator 102. Accordingly, a sound engineer can assess the quantity and/or quality of sound heard by the listener(s).

Figure 1A:
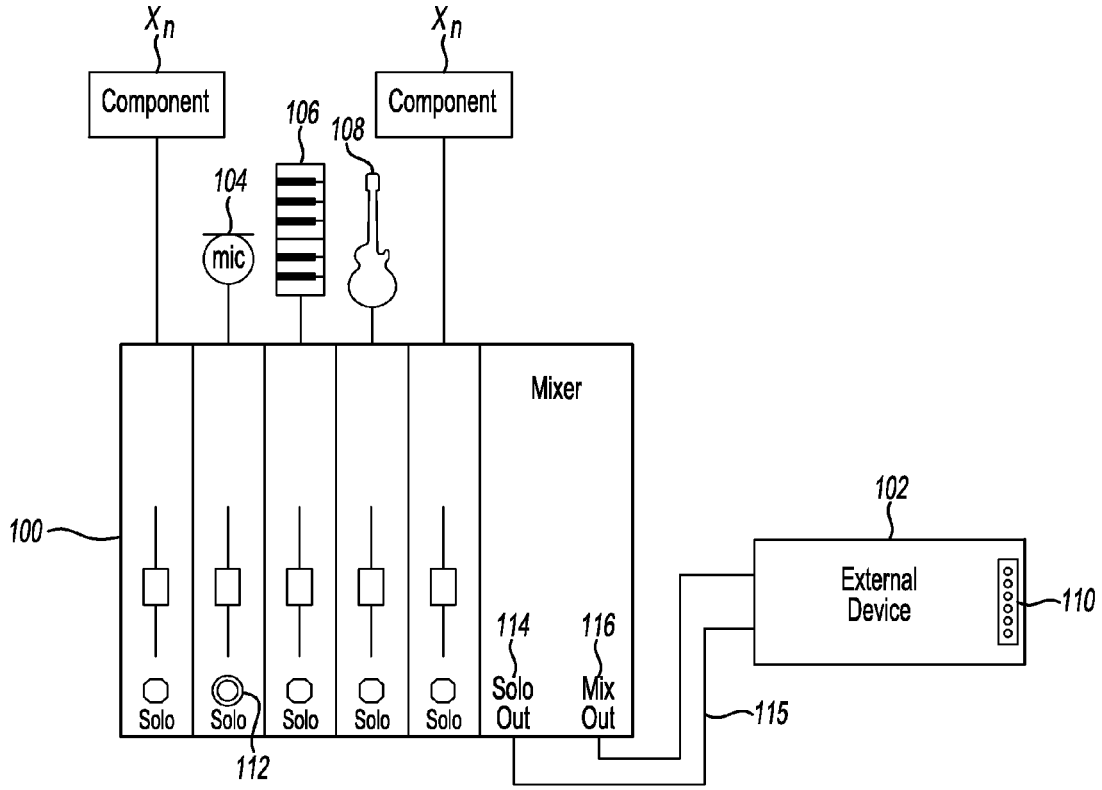
FIGS. 1A and 1B are block topologies of an electronic system embodiment for determining the energy level of a component within a sound mix.

FIG. 1A illustrates a mixing console 100 and a connected presence estimator 102 which may comprise a system for measuring sound signals to determine an energy level of a component within a sound mix according to one exemplary embodiment. The sound signal(s) that are measured may be from sound components connected to the mixing console 100 such as (and without limitation) a microphone 104, a keyboard 106, or a guitar 108. For example, the system may measure the level of vocals or one or more instruments within the sound mix. There may be a number of components connected to the mixer 100 represented in FIG. 1A by $X_n$. Each component is connected to a different channel of the mixer 100. As will be described below, in some embodiments, the presence estimator 102 can determine the energy level from an individual channel (e.g., component).

The presence estimator 102, as illustrated in FIG. 1A, may be a hardware device that may or may not be portable. The connection between the presence estimator 102 and the mixing console 100 may be any wired or wireless connection enabling transfer of audio data between components in real-time or near real-time. Non-limiting examples include USB, Ethernet, BLUETOOTH, Firewire, HDMI, 802.11 standard communication, and the like. The presence estimator 102 may include a microprocessor, such as (and without limitation) a digital signal processor (DSP), may be outfitted with a sound card, may include instructions for measuring isolated sound signals, and may be capable of outputting one or more results describing the level of the isolated signal within the sound mix to a user (such as a sound engineer). For example, the presence estimator may be one or more handheld devices, computers (e.g., laptop, desktop, or embedded PC), mobile phones, tablets, PDAs, or other like devices. In some embodiments, the presence estimator may be a software application stored on and executing from any one or more of these devices.

Figure 4:
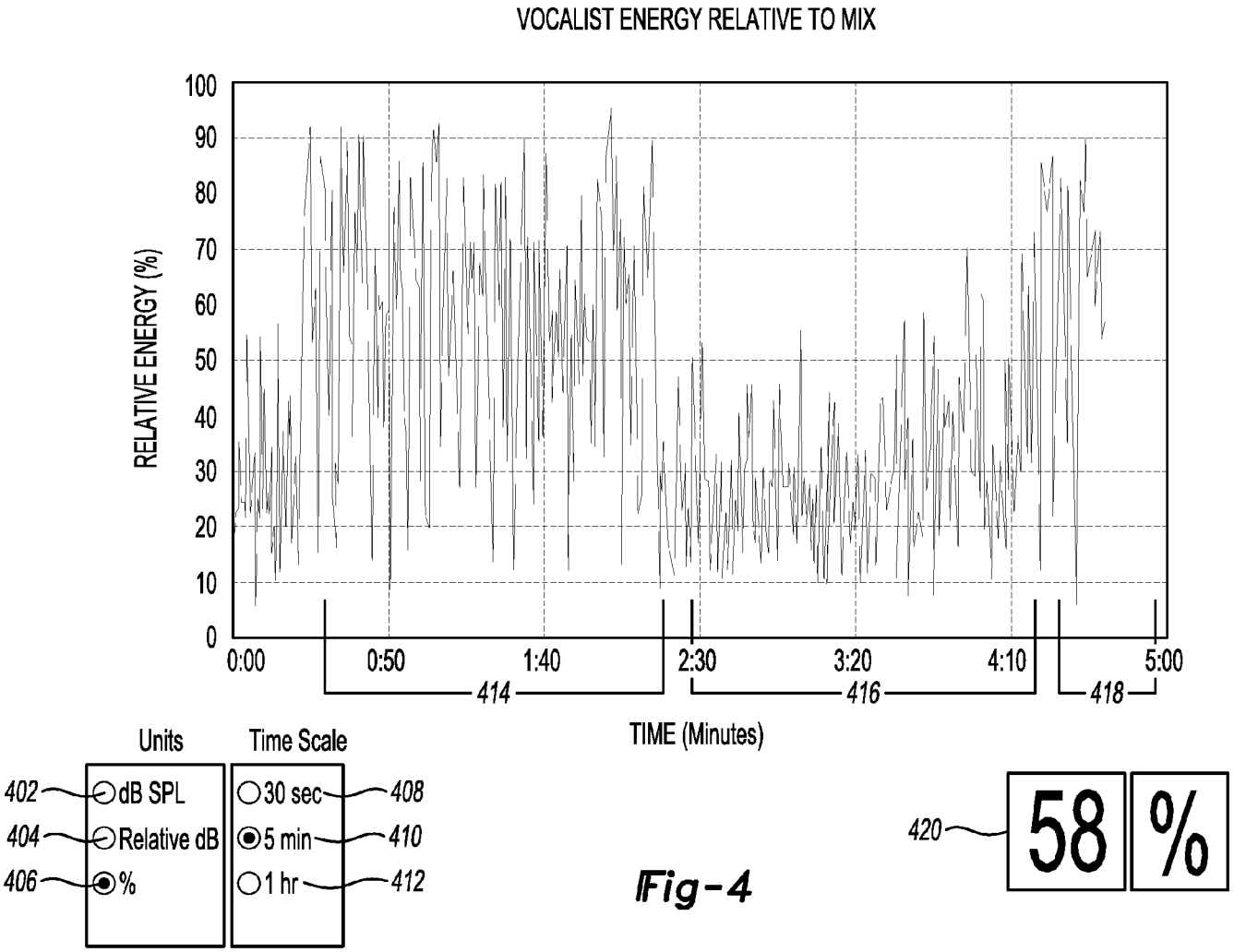
FIG. 4 shows an embodiment of an output for reporting the level of the signal within the sound mix.

In some embodiments, the output may be an analog output (e.g., and without limitation, a needle meter). In additional or alternative embodiments, the presence estimator 102 may include one or more LED lights 110 for reporting the energy level to the user. In additional or alternative embodiments, the presence estimator 102 may include a digital output displaying, e.g., numerical values. In other embodiments, the presence estimator 102 may include a GUI-based meter displayed from a laptop, a PDA, a mobile phone, or a tablet and, therefore, include a display for textually and/or graphically outputting the levels. A non-limiting example of such a display is illustrated in FIG. 4 which will be described in further detail below. In additional or alternative embodiments, the result(s) may be output as speech from the presence estimator 102. In this embodiment, the presence estimator 102 may include instructions for processing the energy level(s) into speech and generating the speech-based results.

Figure 1B:
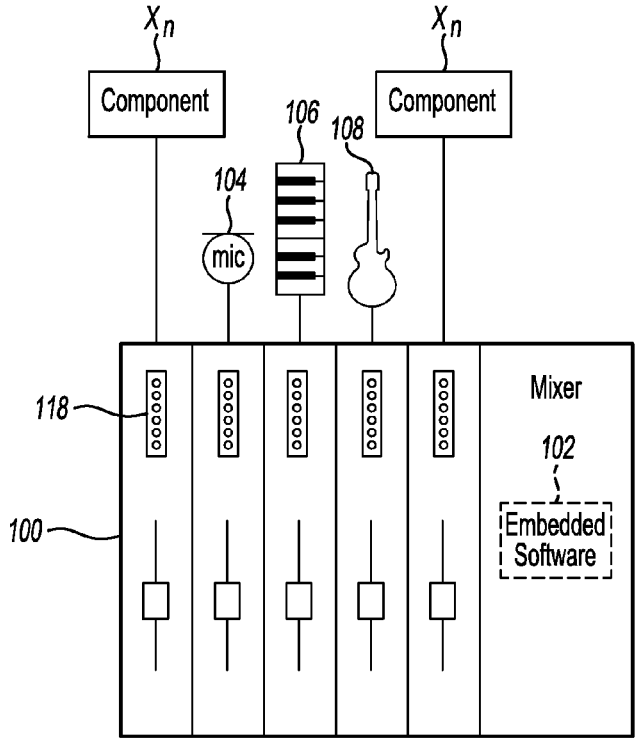
Figure 2A:
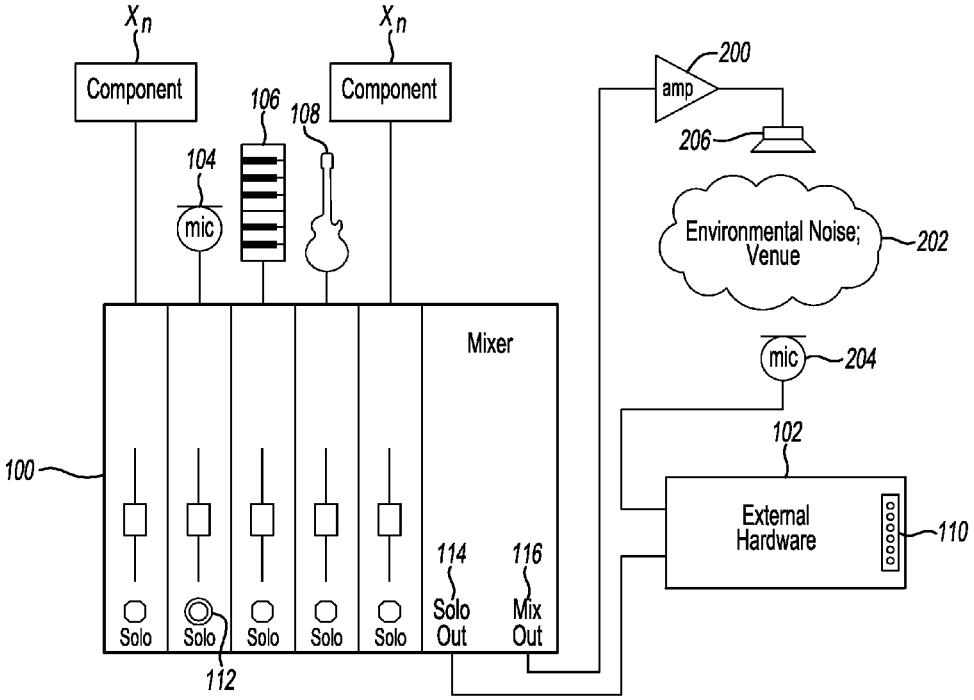
FIGS. 2A and 2B are block topologies of an acoustical system embodiment for determining the energy level of a component within a sound mix.
Figure 2B:
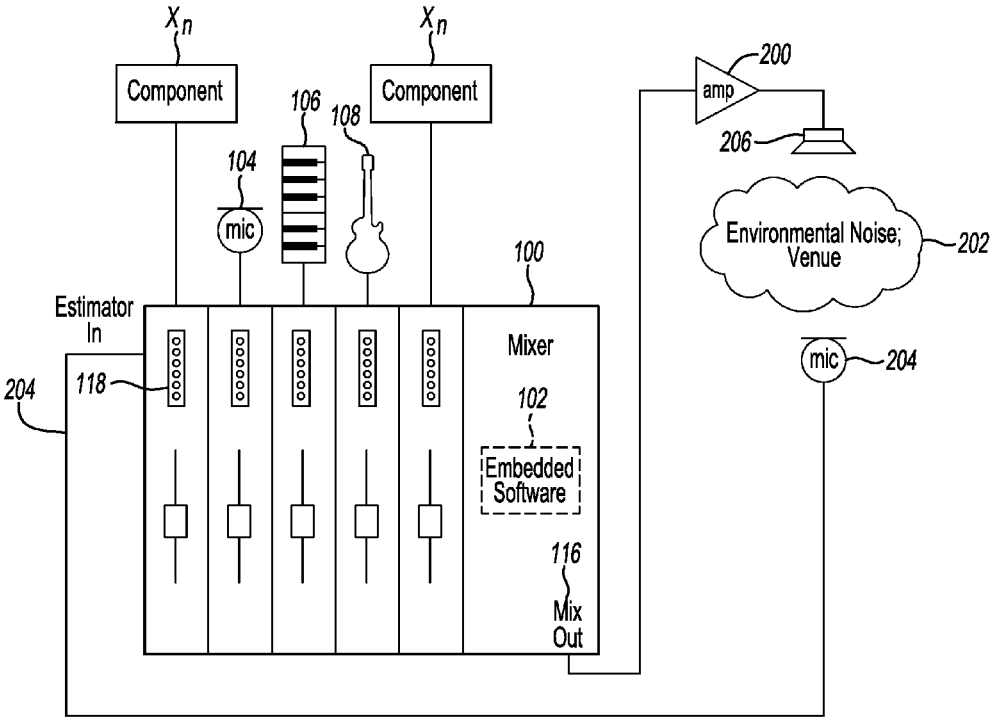

The presence estimator 102 may receive the sound signal(s) of each component of a sound mix as an electronic mix input or an acoustic mix input. A mixing device 100, or mixer, may provide an electronic mix input to the presence estimator 102. One or more microphones 204 in the audience, for example, may provide an acoustic mix input to the presence estimator 102. FIGS. 1A and 1B illustrate embodiments of the electronic mix input. FIG. 2A and 2B, which will be described in further detail below, illustrates embodiments of the acoustic mix input.

In an electronic mix signal, the sound signals are received from the sound components (e.g., the microphone and instruments) by the mixer 100 and the mix signal is generated from the received sound signals. In this embodiment, the mixer 100 may be, for example, on stage and directly connected to the sound components. In an acoustic mix signal, the sound signal(s) may be obtained from one or more microphones placed in the audience or on stage. In this case, in addition to the accompaniment, the sound signal(s) also include the ambient acoustic noise and the response of the loudspeaker (e.g., main loudspeakers, stage monitors, or both) and the room. Accordingly, the sound mix may be tailored to the environment rather than just the accompaniment (as in the case of the electronic sound mix). Each sound mix option is individually advantageous. For example, an electronic sound mix may be generally a cheaper alternative. The acoustic sound mix is more expensive to implement, but may provide better results. While the figures illustrate separate mix inputs, certainly in some embodiments, both an acoustic mix and an electronic mix inputs can be used to evaluate the component sound signals.

As shown in FIG. 1B, an alternate embodiment of the system may include a presence estimator 102 that is embedded software within the mixing console 100. In at least this embodiment, sound components 104, 106 and/or 108 may input sound signals to the mixer 100 and the signal(s) may be processed by the embedded presence estimator 102 to obtain the isolated sound level value. The output may be presented from the mixer 100 or from an external device communicating with the mixer 100 (e.g., wired or wirelessly). The external device may be programmed to receive input from the mixer 100 and generate an output of the result(s) determined by the embedded presence estimator 102. The output may be analog or digital and, further, may be graphical, textual and/or speech-based. Various non-limiting examples of such external devices are described above.

In alternative or additional embodiments, the presence estimator 102, or some functions of the presence estimator 102, may be executing remotely from one or more remote servers communicating with the mixer 100 via the Internet. As a non-limiting example, the calculations for determining the energy level of a component may be performed on the remote server(s). Since the system may typically be used during a live performance, the network(s) facilitate a seamless exchange of signals and data between the mixer 100 and the remote server(s). In some embodiments, this seamless exchange may be in real-time or near real-time.

FIGS. 2A and 2B show alternative embodiments of the system in which the input to the presence estimator 102 is an acoustical mix. In FIGS. 2A and 2B, like reference numerals correspond to like features illustrated in FIGS. 1A and 1B.

FIG. 2A illustrates at least one embodiment of the system using an acoustic mix input 202 in which the presence estimator 102 is an external hardware device as described above with respect to FIG. 1A. A sound mix from the mixer 100 may be output 116 to the venue through one or more loudspeakers 206. Further, the sound may be amplified by one or more amplifiers 200 connected to the loudspeaker(s) 206. In some embodiments, the amplifier(s) 200 and the loudspeaker(s) 206 may also produce noise which can add to the acoustic mix 202.

The acoustic mix 202 may be received by the presence estimator 102 via one or more microphones 204, or other sound capturing devices, placed in an area in the vicinity of such an acoustic mix 202 for determining the strength of a single component. For purposes of brevity, the sound capturing device will be described as a microphone. The output identifying the energy level of the sound component may be presented in any one of a multitude of different ways as described above with respect to FIG. 1.

The acoustic mix 202 may also include extraneous sound signals as part of determining the energy level(s) of a component. Such extraneous sound signals may include, but are not limited to, reverb, echoes, traffic, ambient noise and/or venue noise. As a non-limiting example, the microphone(s) 204 may be placed in the audience of a performance or other event (such as a concert, play, speaking event, or the like) or in a location where sounds from the loudspeaker(s) 206 and extraneous noise (e.g., reverb, echoes, the audience, traffic, and the like) may be captured. The microphone(s) 204 and the presence estimator 102 may communicate through wired and/or wireless communication.

As shown in FIG. 2B, another embodiment of the system may include a presence estimator 102 that is embedded software within the mixing console 100. Sound components 104, 106 and/or 108 may input sound signals to the mixer 100 and the signal(s) may be processed by the embedded presence estimator 102 to obtain the energy level value(s). The sound mix output 116 may be heard in the venue via the loudspeaker(s) 206 and amplified by the amplifiers 200 as described above. The acoustic mix 202 may be received by the microphone(s) 204 and input to the mixer 100 via a wired or wireless input 208 connection for transmission to the embedded presence estimator 102. In some embodiments, the mixer 100 and the microphone(s) 204 may communicate over a network such as a computer network or analog network. The output may be presented from the mixer 100 or from an external device communicating with the mixer 100 as described above with respect to FIG. 1.

FIGS. 1B and 2B illustrate a presence estimator 102 that is embedded in the mixer 100. However, the presence estimator 102 may alternatively be one or more external hardware devices as described with respect to FIGS. 1A and 2A. Likewise, the mixer 100 illustrated in FIGS. 1A and 2A may include an embedded presence estimator 102.

In additional or alternative embodiments, a Y-cable (or other similar cable) may be used to connect the sound components to the mixer 100 and the presence estimator 102. In this case, the signals from the components may be fed directly to the presence estimator for determining and outputting the energy levels.

To determine the energy level from a sound component, the signal(s) from each component can be manually or automatically input to the presence estimator 102. Additionally or alternatively, the energy from a single component/channel may be determined or the energy from multiple components/channels (e.g., using a multi-meter system).

Each of FIGS. 1A, 1B, 2A, and 2B illustrate these different methods in accordance with various embodiments of the invention.

As illustrated in FIGS. 1A and 2A, the mixer 100 may include an input control 112, such as a button, a capacitive input, or other tactile input used to send a single component signal to the mixing console's 100 Solo output 114. Typically, the Solo button is used to receive one signal, which can be heard by the sound engineer using, for example, headphones. In one or more embodiments of the disclosed system, the Solo signal, in response to utilization of the Solo button 112 by a user, may be input 115 to the presence estimator 102. In the non-limiting example shown in FIGS. 1A and 2A, the Solo button 112 for the second channel (in this example, the microphone component 104) is pressed. When using the Solo input 112, the energy level of each component on each channel can be individually determined.

In the exemplary embodiments shown in FIGS. 1A and 2A, the Solo signal output 114 and sound mix output 116 from the mixer 100 may be input to the presence estimator 102. The presence estimator 102 may output the energy level value of the Solo signal corresponding to the selected channel and the energy level value of the total mix as provided from the mix output 116. In some embodiments, the output values from the presence estimator 102 may be used to assess the Solo signal relative to the mix signal. The output may be presented in a multitude of ways as described above.

FIGS. 1B and 2B illustrate embodiments in which the presence estimator 102 determines the energy value of each component through a multi-meter system. The mixer 100 may not include a Solo button 112 for each channel (FIGS. 1A and 2A) or the Solo button(s) may not be utilized. Accordingly, each component signal is evaluated from a total sound mix. The presence estimator 102 may be programmed to receive the signal on each channel of the mixer 100 and evaluate or quantify each signal individually. The determined energy level of each of the components on the multiple channels may be reported to the sound engineer. The energy levels may be reported to the sound engineer in one or more manners described above. In the example shown in FIGS. 1B and 2B, the value(s) may be reported on all meters 118 on the mixing console 100 associated with a sound component.

Figure 3A:
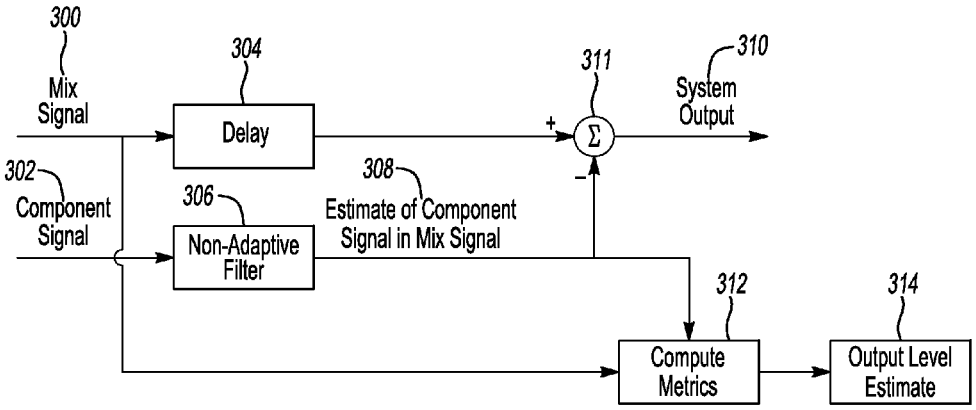
FIG. 3A illustrates the process of determining the energy level of a component within a sound mix using a non-adaptive filter according to one embodiment.
Figure 3B:
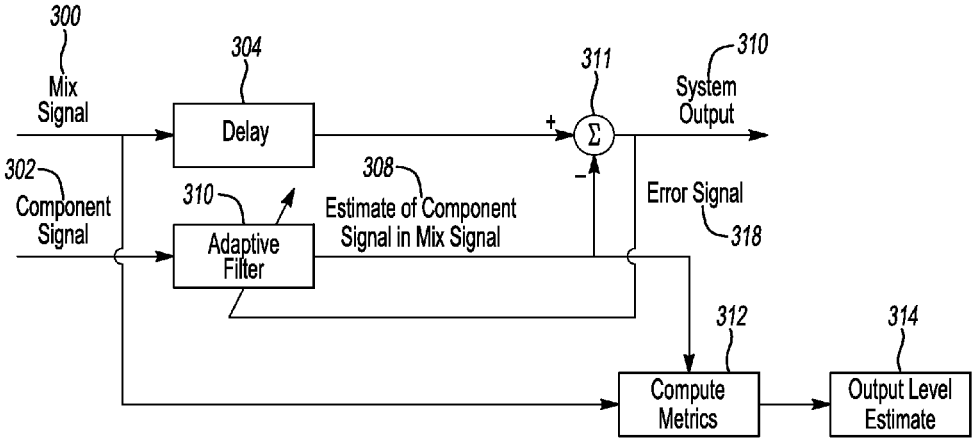
FIG. 3B illustrates the process of determining the energy level of a component within a sound mix using an adaptive filter according to one embodiment; .

FIGS. 3A and 3B illustrate various embodiments of the process for determining component energy level values. The determination process may be performed by the presence estimator 102 as described in the various embodiments above. Like reference numerals in FIG. 3B correspond to like features illustrated in FIG. 3A. In one or more embodiments, a single filter or a plurality of filters may be used to determine the content of each component in the mix. For example, when using a single filter, the presence of a lead component (e.g., the lead singer) may be determined. When using a plurality of filters, the content of each component in the mix of multiple components may be determined.

Referring to FIG. 3A, one or more mix signals 300 and one or more component signals 302 may be received by the presence estimator 102. The signals may be received simultaneously or near simultaneously.

The presence estimator 102 may be a non-causal signal processing system for processing the sound signals. However, a non-causal system is not physically realizable. Accordingly, a delay 304 (e.g., a time-shift) may be inserted in the path of the mix signal(s) 300 to ensure a causal and a physically realizable system. The value of the delay 304 may fall within a certain range. For example, the range may fall broadly higher or lower than an optimum delay value. In some non-limiting embodiments, a delay value equal to half the length of the filter 306 may be used (e.g., ½ of an adaptive filter length equal to "N," wherein N is a numerical value). Of course, other delay values relative to the filter length may be utilized without departing from the scope of the invention.

One or more algorithms for computing the signal level may be utilized to determine or calculate the energy level of the component. The algorithm(s) may be programmed as computer-readable and executable instructions and stored on one or more computer-readable mediums. Non-limiting examples may include non-volatile memory of the presence estimator 102, one or more personal computers (such as a laptop or desktop), or one or more handheld devices. Additional storage mediums may include one or more external hard drives, CD-ROMs, USB drives, or one or more computer servers.

In some embodiments, the algorithm(s) for determining the energy level may be defined as one or more signal processing filters. The filter(s) may be adaptive or non-adaptive. Further, the filters may include mathematical-based algorithms. The architecture and operation of a non-adaptive system is shown in FIG. 3A. The non-adaptive filter may require more memory on the DSP than an adaptive filter. However, the non-adaptive filter may be easier to tune.

The adaptive filter system and process is shown in FIG. 3B and will be described in further detail below. The adaptive systems may typically be modeled using finite impulse response (FIR) filters. An FIR filter may have an impulse response of finite duration (e.g., its response to any finite length input will eventually decay to zero) by excluding feedback from the output. Additional characteristics of the FIR may include stability, having coefficients that are relatively simple to calculate, and the ability to have linear phase.

The adaptive filter is not limited to an FIR topology, however. Other filter topologies may be used as part of an adaptive filter. As a non-limiting example, an Infinite Impulse Response (IIR) filter may be used which includes an internal feedback and may continue to respond indefinitely. In some embodiments, frequency warped or lattice filters may be used.

In a non-adaptive or adaptive filter system, an absolute power of a component and/or a relative power of a component relative to the mix may be determined. Relative energy may indicate the presence of the component in the mix, for example, above the accompaniment. Absolute energy may indicate loudness of the component, which will be insensitive to changes in the accompaniment.

With the component signal 302 as input, the filter (non-adaptive, block 306 or adaptive, block 316 in FIG. 3B) may identify the component signal by determining the value of the signal within the mix signal 308. In some embodiments, the determination may be an estimated value.

The component signal in the mix 308 may be used for output at a performance or event (block 310). The component signal in the mix 308 may be subtracted 311 from the mix signal for generating the system output (block 310). Alternatively or additionally, the component signal in the mix 308 may be input to compute the component energy level (block 312) as an absolute and/or relative value. Based on the computation(s) (as described below), the energy level value may be output (block 314). In some embodiments, the output of the identified component signal in the mix 308 with the mix signal and the input of the component signal in the mix 308 may occur simultaneously.

In a non-adaptive filter system (FIG. 3A), when determining the absolute power of a component (Ec), the component energy level may be determined based on equation 1. The absolute power may be represented in dB SPL (Sound Pressure Level) if the microphone has been calibrated. Alternatively, the absolute power may be represented in Pascals (Pa).

$$Ec=E[|y(n)|^2] \quad \text{Equation 1:}$$

When determining the relative power of a component within the mix (Em), the component energy level value may be determined based on equation 2. The relative power may be represented in dB (Decibel) and/or percentage.

$$Em=E[|y(n)|^2]/(E[|d(n)|^2]+\epsilon) \quad \text{Equation 2:}$$

In equations 1 and 2, y(n) is the estimate of the component signal as may be determined by the filter 306 from equation 3 below. Further, in equation 2, "ϵ" is the regularization constant and d(n) is the mix signal at a time instant "n."

$$y(n)=h^T x(n) \quad \text{Equation 3:}$$

The non-adaptive filter coefficients, or the N-by-1 filter tap-weight vector, represented in the above equation 3 as "h," may be defined by equation 4:

$$h=(R_{xx}+\epsilon I)^{-1}P_{dx} \quad \text{Equation 4:}$$

Wherein "I" is an identity matrix of dimension N-by-N, $R_{xx}$ defines an auto-correlation matrix and $P_{dx}$ defines a cross-correlation vector based on the following definitions:

Auto-correlation matrix: $R_{xx}=R_{xx}/M$, where $R_{xx}=R_{xx}+x(n)x(n)^T$ based on an initialization of $R_{xx}$=N-by-N zero matrix Cross-correlation vector: $P_{dx}=P_{dx}/M$, where $P_{dx}=P_{dx}+d(n-\Delta)x(n)$ based on an initialization of $P_{dx}$=N-by-1 zero vector.

In the above equations, M is the block size of signal samples; N is the number of filter coefficients; $(.)^T$ denotes the transpose operator; $E[I(.)|^2]$ denotes the expectation (average) operator computed over the current block of M samples, n=0, 1, 2, . . . , M-1; x(n) is N-by-1 component signal vector at a time instant "n"; and Δ is the delay value. In some embodiments of a non-adaptive system, equations based on Wiener-Hopf equations may be used to determine energy values.

In contrast to a non-adaptive filter system, in an adaptive filter system, one or more error signals 318 may be generated to iteratively improve the previous estimate of the adaptive filter coefficients (as shown in FIG. 3B). An adaptive filter uses feedback in the form of an error signal to refine its transfer function to match changing parameters. A transfer function is a representation of the relation between the input and output of a system represented in terms of spatial or temporal frequency.

Adaptive systems have been used in a number of different applications such as prediction, system identification, equalization (e.g., deconvolution, inverse filtering, inverse modeling), and interference cancellation. Such applications may involve an input signal, a desired output signal, and an actual output signal. Further, adaptive systems generate error signals which may be defined as the difference between the desired output signal and the actual output signal. By minimizing some measure of the error, an adaptive algorithm may adjust the structure of the adaptive system to ensure that the actual output of the adaptive system closely resembles the desired output signal. One such adaptive process involves minimizing the mean-square of the error signal. Using this criterion, a number of different adaptive algorithms can drive the adaptive system. One non-limiting example is the least-mean-squares (LMS) adaptive algorithm and its variants. Of course, other cost functions involving an error signal may be used to derive either adaptive or non-adaptive systems. Non-limiting examples may include the minimum mean square error (MMSE), fourth power, absolute value, sign, and the like.

In an adaptive filter system (FIG. 3B), when determining the absolute power of a component (Ec), the component energy level value may be determined based on equation 5. The absolute power may be represented in dB SPL (Sound Pressure Level) if the microphone has been calibrated. Alternatively, the absolute power may be in Pascals (Pa).

$$Ec=E[|y(n)|^2] \quad \text{Equation 5:}$$

If the relative power of a component within the mix (Em) is determined, the component energy level value may be determined based on equation 6. The relative power may be represented in dB (Decibel) and/or percentage.

$$Em=E[|y(n)|^2]/(E[|d(n)|^2]+\epsilon) \quad \text{Equation 6:}$$

In equations 5 and 6, y(n) is the estimate of the component signal as may be determined by the filter 316 from equation 7 below. y(n) may be calculated for each new block of "M" signal samples. Further, in equation 6, d(n) is the mix signal at a time instant "n" and c is the regularization constant.

$$y(n)=h^T(n)x(n) \quad \text{Equation 7:}$$

The adaptive filter coefficients (also known as "taps"), represented in the above equation 7 as "h," may be defined by equation 8:

$$h(n+1)=h(n)+\mu_N x(n)e(n) \quad \text{Equation 8:}$$

h(n+1) may define the N-by-1 adaptive filter tap-weight vector at time instant n+1. In some embodiments, the tap-weight vector h(n) may be known in which case an appropriate value may be selected for h(0). If h(n) is not known, h(0) may be initialized to a N-by-1 zero vector. The adaptive filter coefficient(s) may be determined for each new block of "M" signal samples.

In equation 8, $\mu_N$ may represent the normalized adaptation step size. Adaptive algorithms may exhibit better convergence characteristics using a normalized step-size ($\mu_N$) as opposed to an un-normalized step-size (μ). The normalized adaptation step size may be calculated as follows:

$$\mu_N=\mu/\|x(n)\|^2+\epsilon) \quad \text{Equation 9:}$$

In some embodiments, normalization may be accomplished using the error signal e(n). e(n) is defined below in equation 10.

In the adaptive filter system, the value of one or more error signals may be determined. The value of the error signal may be used to determine the adaptive filter coefficients (equation 8). The following equation may be used to calculate the error signal:

$$e(n)=d(n-\Delta)-y(n) \quad \text{Equation 10:}$$

In the above equations, M is the block size of signal samples; N is the number of filter coefficients; $(.)^T$ denotes the transpose operator; $E[|(.)|^2]$ denotes the expectation (average) operator computed over the current block of M samples, n=0, 1, 2, . . . , M-1; x(n) is N-by-1 component signal vector at a time instant "n"; and 0 is the delay value.

Figure 3C:
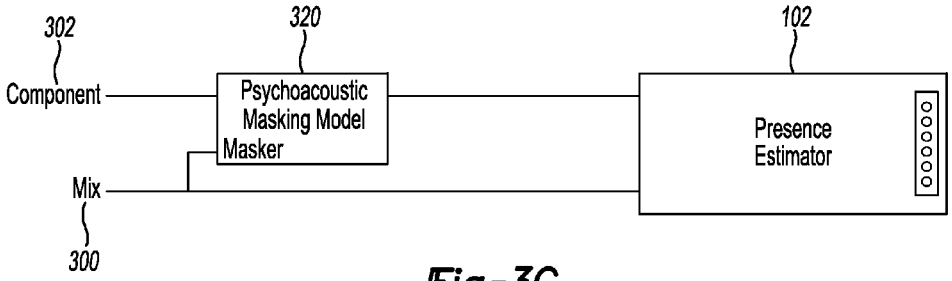
FIG. 3C illustrates the process of determining the audibility of a component according to one embodiment.

In additional or alternative embodiments, as shown in FIG. 3C, the presence of the component may be enhanced by using a masking model 320. A masking model predicts how parts of a sound may be masked by one or more other sounds. Information from the masking model may be used to improve the quality of reproduction of the one or more sounds. Accordingly, the audibility of the component signal can be optimized as well.

The masking model 320 may be programmed as software having instructions for the mix signal to mask the component signal. The software may be programmed to memory of the presence estimator 102 or stored on a computer readable medium such as a CD, DVD, or USB stick and executed by a computer (as shown in FIG. 3C for purposes of clarity).

In operation, the masking model may have two inputs: the component signal, which may be processed by the presence estimator 102 (as described above), and the mix signal which may mask the component signal. The output from the masking model software may be input to the presence estimator 102 for determining the audibility of the component signal.

FIG. 4 illustrates a GUI implementation 400 of the signal level output as determined by the presence estimator 102. The result may be measured in a plurality of different units. In this non-limiting example, there are three units: dB SPL 402, relative dB 404, and percentage 406. Certainly, other units of measurement may be used and/or measurements of different units may be displayed together. Further, the output may be a function of the time scale used. In this example, the time scale used is 30 seconds 408, 5 minutes 410, or 1 hour 412. Certainly, other time scales may be utilized according to the specific implementation of the invention.

In the result displayed 400 in FIG. 4, the output is measured in percentage 406 and the time scale is set to 5 minutes 410. The presence estimator 102 is determining and outputting a female vocalist's signal energy for approximately 2 minutes (graph portion 414). After 2 minutes, the vocalist stops singing while a saxophonist and pianist take solos (graph portion 416). After 4 minutes, the singer starts singing again (graph portion 418). Accordingly, when the vocalist is not singing, the number drops very low (which is expected). While singing, however, the percentage of the singer's energy is between 70% and 90%.

In some embodiments, the output may additionally or alternatively include a numerical value 420. Value 420 may represent the energy level at a certain point in time, the average value within the timeframe (e.g., 5 minutes), or the current energy level. Of course, the numerical value will adjust in accordance with change in energy level.

Likewise, if the absolute energy 402 or the relative energy 404 is selected by the user to be determined and reported, the output 400 may show the range of the singer's energy in dB SPL (absolute energy) or dB (relative energy). In some embodiments, the visual output may additionally or alternatively include a numerical value.

In some embodiments, a notification may be generated (e.g., by the presence estimator 102 and/or other software component) to notify the user where to increase the sound or decrease the sound (e.g., increase or decrease the gain) depending on the energy level of the component. For example, if the vocalist's energy is too low while singing, the sound engineer may be notified which component(s) need to be adjusted. In some embodiments, an auto-mixer may be used to automatically adjust the sound.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for determining power levels of one or more sound components from a sound mix, the system comprising:

at least one sound mixing device configured to output a sound mix signal generated by mixing a plurality of component signals from a plurality of sound components and a first component signal that is generated from a first sound component included in the plurality of sound components and is separate and distinct from the sound mix signal; and at least one energy level determining apparatus for the one or more sound components, the energy level determining apparatus configured to:

receive from the mixing device the sound mix signal;

receive from the mixing device the first component signal determine the sound mix signal at a first time instant;

compute, via a tap filter, an estimate of the first component signal at the first time instant; and determine the relative power of the first component signal within the mix signal based on an absolute power of the estimate of the first component signal at the first time instant and an absolute power of the sound mix signal at the first time.

2. The system of claim 1 wherein the at least one energy level determining apparatus is further configured to compute the absolute power of the estimate of the first component signal at the first time instant.

3. The system of claim 1 wherein the at least one energy level determining apparatus is further configured to execute instructions defining a signal processing filter to compute the absolute power of the estimate of the first component signal at the first time instant.

4. The system of claim 3 wherein the signal processing filter is non-adaptive.

5. The system of claim 3 wherein the signal processing filter is adaptive.

6. The system of claim 1 wherein the at least one energy level determining apparatus comprises software embedded in the mixing device.

7. The system of claim 1 wherein the at least one energy level determining apparatus comprises at least one peripheral device connected to the mixing device.

8. The system of claim 7 wherein the at least one peripheral device comprises a handheld device or a computer.

9. The system of claim 1 wherein determining the relative power of the first component signal within the mix signal is based on an analog output, digital output, graphical output, or a speech-based output.

10. The system of claim 1 wherein the sound components include one or more microphones, one or more musical instruments, or both.

11. A method for determining power levels of one or more sound components from a sound mix, the method comprising:

receiving a sound mix signal from at least one mixing device;

receiving at least one component signal from one or more sound components, wherein the at least one component signal is separate and distinct from the sound mix signal;

determining the sound mix signal at a first time instant;

computing, via a tap filter, an estimate of the at least one component signal at the first time instant; and determining the relative power of the at least one component within the mix signal based on an absolute power of the estimate of the at least one component signal at the first time instant and an absolute power of the sound mix signal at the first time instant.

12. The method of claim 11 wherein receiving the at least one component signal includes receiving at least one component signal from a single sound component based on an input on the mixing device defining single component signal transmission, wherein the output is of the single sound component.

13. The method of claim 11, further comprising computing the absolute power of the estimate of the at least one component signal at the first time instant.

14. The method of claim 13 wherein the mixing device outputs the sound mix signal to one or more speakers.

15. The method of claim 14 wherein the sound mix signal and the absolute power of the estimate of the at least one component signal at the first time instant are output simultaneously.

16. The method of claim 11 further comprising receiving the sound mix signal and the at least one component signal simultaneously.

17. The method of claim 11 further comprising delaying transmission of the sound mix signal to generate a causal signal processing system from a non-causal signal processing system.

18. A system for determining power levels of one or more sound components from a sound mix, the system being configured to:

receive a sound mix signal that includes ambient noise;

receive at least one component signal from one or more corresponding sound components, wherein the at least one component signal is separate and distinct from the sound mix signal;

determine the sound mix signal at a first time instant;

compute, via a tap filter, an estimate of the at least one component signal at the first time instant; and determine the relative power of the at least one component within the mix signal based on an absolute power of the estimate of the at least one component signal at the first time instant and an absolute power of the sound mix signal at the first time instant.

19. The system of claim 18 wherein the ambient noise includes one or more of traffic noise, amplifier noise, loudspeaker noise, and audience noise.

20. The system of claim 18 wherein a sound mix is balanced based on the relative power of the at least one component within the mix signal.

21. The system of claim 20 further configured to transmit the relative power of the at least one component within the mix signal for automatic balancing of the sound mix.

22. The system of claim 18 further configured to output the relative power of the at least one component within the mix signal and audibility of the at least one component.

* * * * *